United States Patent [19]

Corry

[11] Patent Number: 4,719,783

[45] Date of Patent: Jan. 19, 1988

[54] PORTABLE PIPE BENDING MACHINE

[75] Inventor: Martin C. Corry, Rydal, Pa.

[73] Assignee: Joan G. Frost, Rydal, Pa.

[21] Appl. No.: 860,986

[22] Filed: May 8, 1986

[51] Int. Cl.[4] ..... B21D 7/02

[52] U.S. Cl. ..... 72/217; 72/219

[58] Field of Search ..... 72/215, 216, 217, 218, 72/219

[56] References Cited

U.S. PATENT DOCUMENTS

| | | | |
|---|---|---|---|
| 1,136,252 | 4/1915 | Meier | 72/219 |
| 1,419,755 | 6/1922 | Potter | 72/219 |
| 2,569,544 | 10/1951 | Tai | 72/219 |
| 4,355,528 | 10/1982 | Rothenberger | 72/217 |
| 4,608,849 | 9/1986 | Brugman | 72/219 |

*Primary Examiner*—W. D. Bray

*Attorney, Agent, or Firm*—John W. Logan, Jr.

[57] ABSTRACT

A portable pipe-bending machine that makes uniform and consistent bends of varying degree curvature in pipes is disclosed. The pipe-bending machine has a stabilizing platform to resist counter-bending forces and interchangeable elements to accommodate pipes of a different thicknesses. The pipe is forced between a solid mandrel and a movable semi-sleeve in a rotation yoke and the yoke is moved at a pre-set number of degrees, thereby putting the desired bend in the pipe.

5 Claims, 9 Drawing Figures

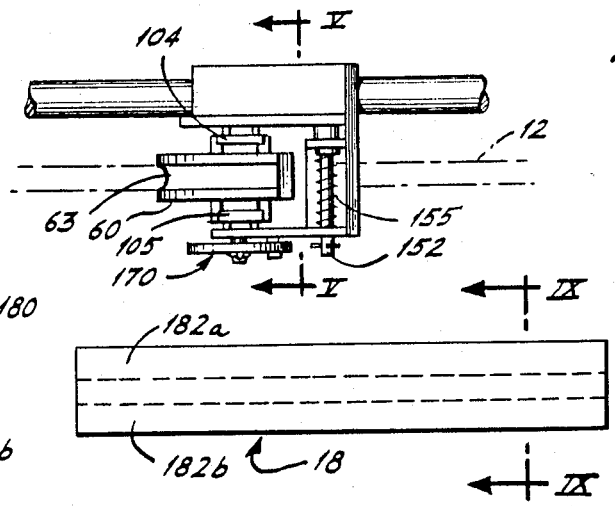
FIG. 4.
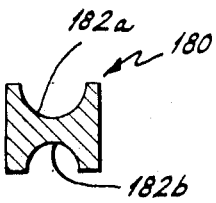
FIG. 9.
FIG. 8.
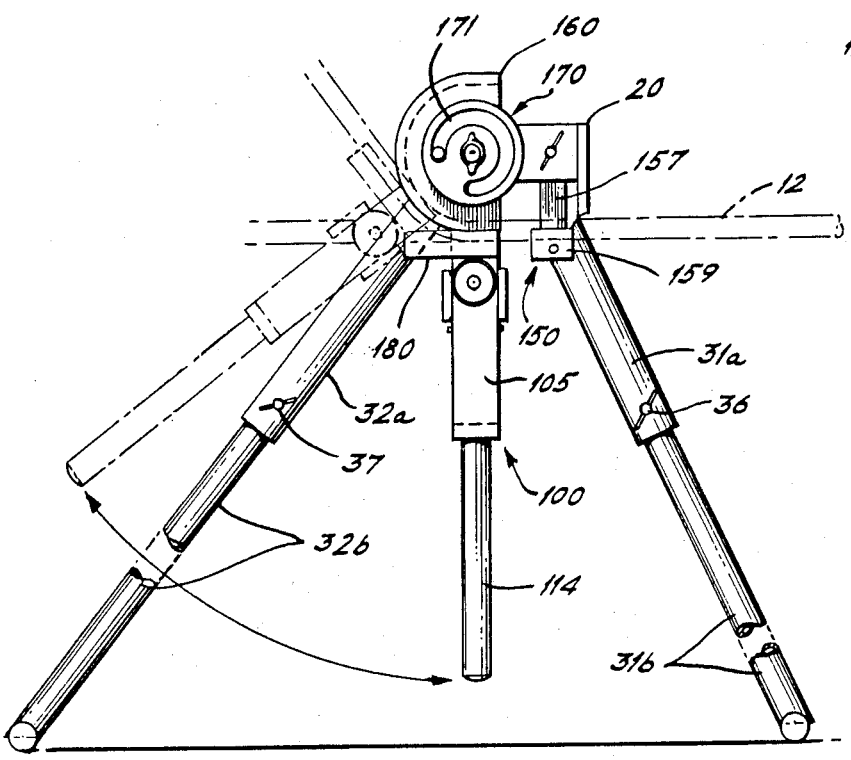
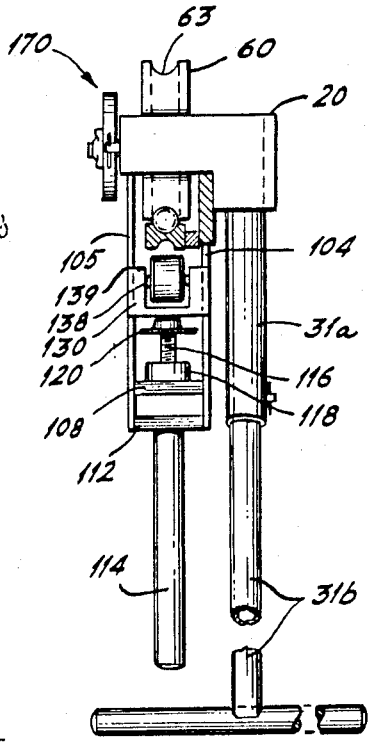
FIG. 2.
FIG. 3.
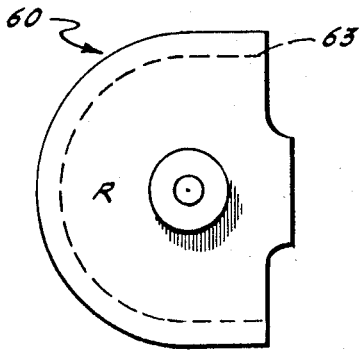
FIG. 7.

PORTABLE PIPE BENDING MACHINE

FIELD OF THE INVENTION

This invention relates to the plumbing industry. More particularly, the invention provides an easily-used and portable machine that allows a plumber to produce accurate, uniform bends in pipes with varied diameters.

DESCRIPTION OF THE PRIOR ART

A pipe bending or forming machine allows a worker to form straight sections of pipe into the required curves for a particular construction. Such a machine is disclosed in British Pat. No. 1,163,407 wherein a section of pipe is forced against a semi-circular forming section by a press. This invention uses a removable setting piece to determine the spacing between the press and a pipe guide and is awkward to use if pipes of different thickness are to be bent.

SUMMARY OF THE INVENTION

The present invention overcomes the above limitations by providing a pipe bending machine with an easily adjustable bending section to facilitate the bending of pipes having different thicknesses. A bending mandrel that is secured against a steady, yet portable and easily transportable, base is provided. A rotation yoke is rotatably secured to the mandrel and provides pressuring movement around said mandrel to force the pipe into a desired bend. A curvature guide attached to the mandrel allows repetitive bends to be made.

OBJECTS OF THE INVENTION

It is therefore an object of the present invention to provide a machine that will easily bend sections of pipe.

It is a further object of the present invention to provide a machine that will easily reproduce the same bend in a multitude of sections of pipe.

It is a still further object of the present invention to provide a machine that will bend sections of pipe without crimping the bent sections.

These and other objects and advantages of the present invention will be readily apparent to those skilled in the art by reading the following brief descriptions of the drawings, detailed description of the preferred embodiment and the appended claims.

BRIEF DESCRIPTION OF THE FIGURES

FIG. 2 is a side view of the instant invention showing a section of pipe (in phantom) and a rotation of 45° (as shown by the arrows) of the yoke housing (also in phantom) to put a bend in the section of pipe (also in phantom);

FIG. 3 is a front elevation view of the instant invention;

FIG. 4 is a fragmentary plan view of the instant invention;

FIG. 7 is a side view of one size of mandrel 60 showing the bottom of groove 63 in phantom;

FIG. 8 is a side view of one form of semi-sleeve 180 showing the bottoms of grooves 182*a*, 182*b* in phantom; and FIG. 9 is a sectional view along IX—IX of FIG. 8.

DESCRIPTION OF THE PREFERRED EMBODIMENT

Figure 1:
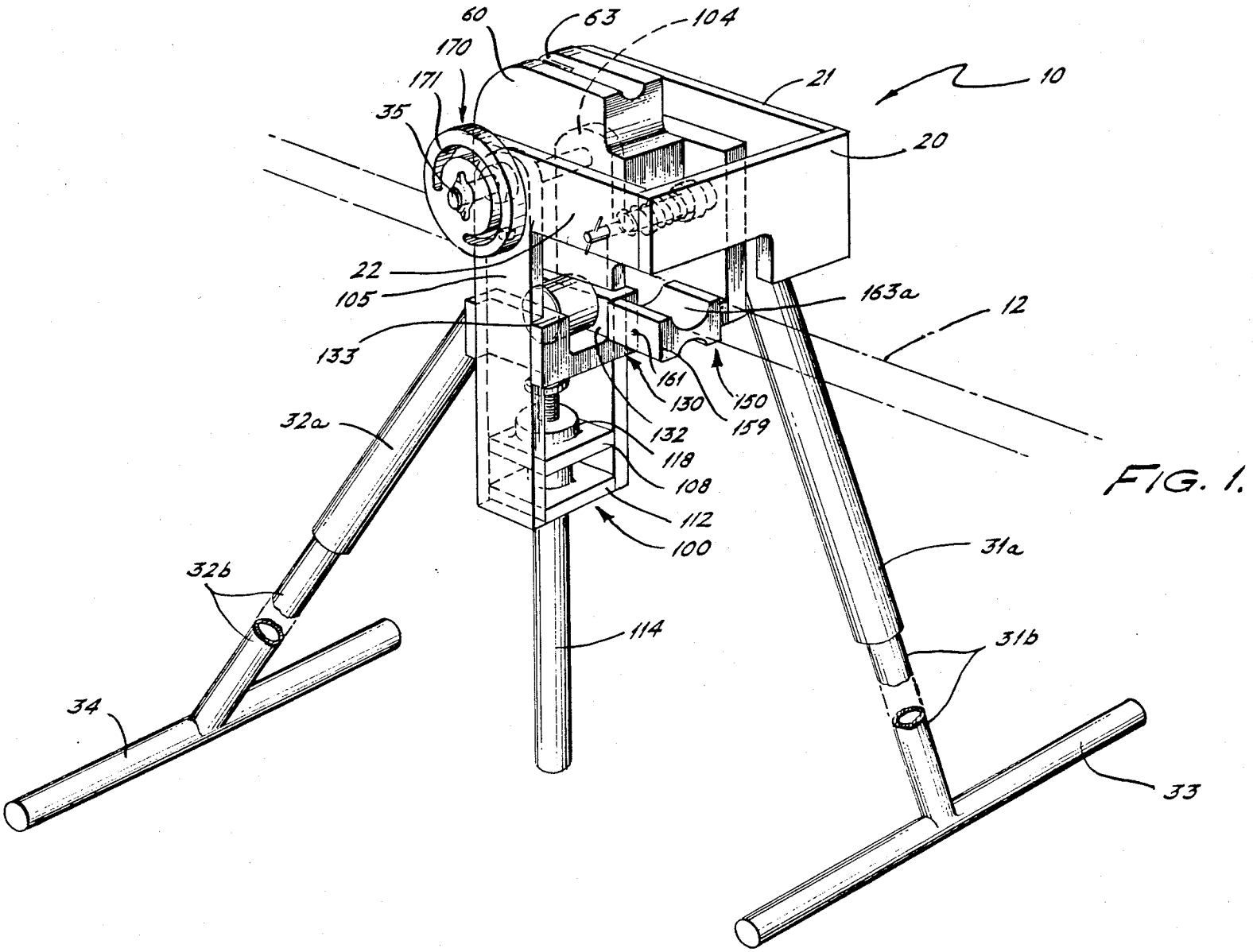
FIG. 1 is a perspective view of the instant invention showing hidden lines of the yoke housing and a section of pipe and the spring mechanism in phantom.

As seen in FIG. 1, the portable pipe bending machine 10 has a mounting bracket 20 with two pivotable and adjustable bracing supports 31, 32 extending therefrom. Mounting bracket 20 is comprised of an end wall and a pair of oppositely spaced parallel side walls 21, 22 extending therefrom. Bracing supports 31, 32 provide a solid and steady working platform from which the portable pipe bending machine may be used. Upper support 32*a* is fixedly fastened at its proximal end to right side wall 21 as is known in the art. Upper support 31*a* is rotatably fixed at its proximal end to right side wall 21 to allow it to be rotated into a parallel position with upper support 32*a* to facilitate carrying. Both legs are telescopingly adjustable and lower supports 31*b*, 32*b* slide into, and lock inside via lock pins 36, 37, upper supports 31*a*, 32*a* as is known in the art, to raise or lower the operating height of pipe bending machine 20. At their distal ends, each of supports 31*b*, 32*b* are connected at right angles to horizontal feet sections 33, 34.

An interchangeable bending mandrel 60 is solidly fixed to mounting bracket 20 by an assembly pin 35. Pin 35 is located at a predetermined position and connects between the distal ends of right side wall 21 and left side wall 22. Mandrel 60 is a solid forming mandrel of a predetermined thickness with a semicircular groove of predetermined size running along the center of the back side thereof. Groove 63 is formed to accommodate, for example, a pipe section 12 (as seen in phantom) with an outside diameter of ½ inch or, if mandrel 60 is changed, pipe with an outside diameter of ¾ inch. As seen in FIGS. 2 and 7, mandrel 60 has an outline of a semicircle with a predetermined radius R. The phantom lines in FIG. 7 show the position of the bottom of groove 63 in the outer surface of mandrel 60.

Extending down from opposite sides of pin 35 are arms 104, 105 of rotation yoke 100 as can be seen in FIGS. 3 and 4. Arms 104, 105 are joined after a predetermined distance thereof by a stabilizing section 108 and a parallel base 112 parallel thereto. Both base 112 and section 108 have a hole of a predetermined diameter drilled through the geometrical centers thereof to accommodate a handle 114. Handle 114 has a distal end 115 and a threaded proximal end 116, which proximal end extends through base 112 and stabilizing section 108 to adjustingly contact a roller housing 130. Stabilizing section 108 has a lock section 118 fixedly attached over the center thereof to allow end 116 to extend therethrough and end 116 has a lock ring 120, as is known in the art, threadedly engaged therearound, both for a purpose to be described later.

Roller housing 130 consists of a pair of parallel side walls 132, 133 joined at the bottom thereof by a base 135. Side walls 132, 133 are dimensioned to fittingly slide against the inside surface of yoke arms 104, 105 and the bottom of base 135 rides against the top of proximal end 116. At a predetermined location above base 135, a roller pin 138 extends between walls 132 and 133. A roller 139 (as seen in phantom in FIG. 2) has a central bore therethrough, which allows roller 139 to spin freely on pin 138.

A pivotable pipe guide holder 150 (as seen in FIGS. 1 and 4) extends from the inside of right side wall 21 on a pin 152 which connects between side wall 22 and right side wall 21. Pin 152 is spaced apart a predetermined distance from the end of bending mandrel 60 and carries on it in free rotation a helically wound extension spring 155 (as seen in FIGS. 1 and 2) which spring 155 is attached to the inside of wall 22. The opposite end of spring 155 is fixed to a rotatable piece 157 which piece 157 extends from mandrel 60 down a predetermined distance. At the distal end of piece 157 is attached a rotatable pipe guide tray 159 with predetermined semi-circular grooves 163*a*, 163*b* that can cradle and steady the free end of section 12 for a purpose to be described later. Tray 159 can be reversed to put groove 163*b* on top by adjusting a screw 161, or other similar device.

Figure 5:
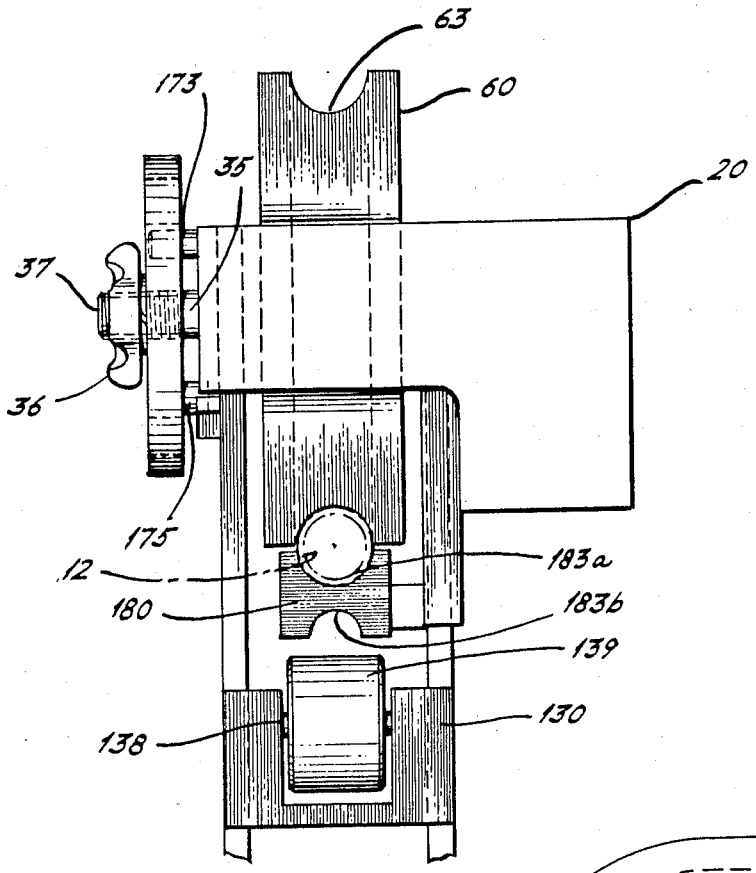
FIG. 5 is an enlarged fragmentary front elevation sectional view taken along lines V—V of FIG. 4.
Figure 6:
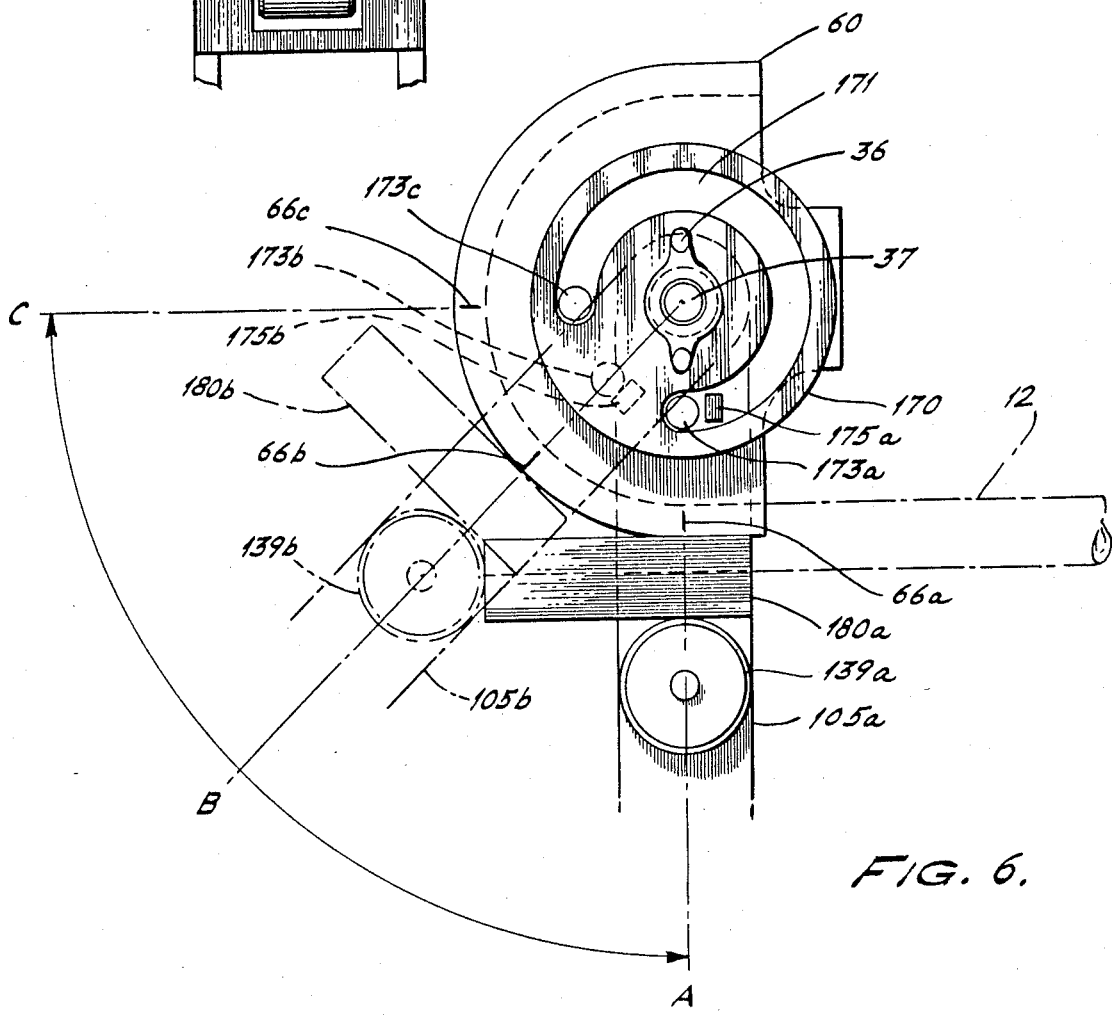
FIG. 6 is a fragmentary side view of a schematic showing operation of the curvature guide 170 and rotation yoke 100.

Rotatably affixed outwardly of side wall 22 on the end of assembly pin 35 is a wheel-shaped curvature guide 170. As shown in FIGS. 5 and 6, curvature guide 170 is fixedly rotatable on pin 35 and has an inner circumference 171 bored therethrough around approximately 315° of said circumference. Guide 170 has on its inner wall at a predetermined location a stud 173 for engagement with a pin 175 protruding from the outside wall of yoke arm 105 and is fixedly fastened onto pin 35 by tightening a wing-nut 36 over a threaded end 37 as is known in the art.

As can be seen in FIGS. 2, 5 and 9, a combination semi-sleeve 180 is placed between pipe section 12 and roller 139 prior to bending operations. FIG. 9 shows a sectional view of semi-sleeve 180 taken along lines IX—IX of FIG. 8. Semi-sleeve 180 has a pre-determined semi-circular groove 183*a*, *b* (as shown in phantom in FIG. 8) to conform to the outside diameter of pipe section 12 and can be changed, as needed, to conform to a specific outside diameter dimension of a section of pipe.

The operation of pipe bending machine 10 can be seen by referring to FIGS. 2 and 6. As earlier mentioned, FIG. 6 is a fragmentary side view of a schematic of pipe bending machine 10. Motion of yoke 100 around mandrel 60 is depicted by showing three possible angular positions, denoted as A, B, C to represent circular rotation of yoke 100 of O°, 45° and 90°, respectively.

Before inserting a section of pipe into machine 10, the outside diameter dimension is measured, or otherwise verified, and the proper size mandrel 60, semi-sleeve 180 and tray 159 are selected and attached at their respective positions. FIG. 2 shows a section of pipe 12 inserted in machine 10 after the above-specified operations have been completed. Pipe guide holder 150 cradles the free end of section 12 and yieldingly releases tension on section 12 by reaction of spring 155 to the bending forces exerted on section 12 when yoke 100 is rotated.

After the properly sized parts have been selected and installed, curvature guide 170 is rotated to indicate, in conjunction with pre-determined guide marks, such as for example 66A, 66B and 66C, on mandrel 60, what degree of bend is to be put into pipe section 12. Wing nut 36 is loosened from pin 35 and stud 173B is aligned with a mark, 66B for example, and then wing nut 36 is tightened to prevent further rotation. The construction of mandrel 60, yoke arms 104, 105, curvature guide 170 and wing nut 36 on assembly pin 35 and installed in side walls 21, 22 is done to allow free rotation of arms 104, 105 only once wing nut 36 is tightened up.

Handle 114 is twisted sufficiently to allow enough of threaded screw end 116 to force housing 130, and roller 139, and semi-sleeve 180 against pipe section 12. FIG. 3 shows lock nut 120 at the top of screw end 116 and to lock roller 139 in this position, it is simply reversed down end 116 until it becomes tight against section 118. In this configuration, semi-sleeve 180 and mandrel 60 completely encircle pipe 12 and serve to distribute bending forces evenly over the pipe's surface.

Pin 175 is in the 6 o'clock position, as seen in FIG. 6 as position 175A, and will move with yoke 100 as a bend is put in section 12. If, for example, curvature guide 170 had been earlier rotated to place stud 173 at position 173B, then yoke 100, with roller 139 and semi-sleeve 180 pressuring pipe section 12, will be rotated until pin 175 contacts stud 173 as seen by 175B and 173B. This rotation will put a bend of 45° (within acceptable tolerances) into pipe section 12. In a similar manner, a bend of 90° could be obtained by adjusting stud 173 to position 173C and rotating yoke 100 until pin 175 makes contact at that point (not shown).

Many modifications and variations of the present invention are possible in light of the above teachings, and it is therefore understood that within the scope of the disclosed inventive concept, the invention may be practiced other than specifically described.

What is claimed is:

1. A portable pipe-bending machine comprising:

stabilizing means to provide a secure platform from which to exert leverage against a section of pipe; and bending means fixedly adjustable inside said stabilizing means to force the section of pipe into a predetermined curve and including rotatable pressure means for simultaneously forcing the section of pipe into a groove in a stationary bending mandrel and being rotatable around said predetermined curve and guide means located adjacent said mandrel to restrain the curved surface of the pipe as said pressure means is moved;

wherein said stabilizing means includes a mounting bracket and a plurality of telescopingly adjustable legs, at least one of which is pivotally movable to and securable in a desired position;

wherein said bending means includes a curvature guide to predetermine the degree of curve to be put into the section of pipe; and wherein said bending means includes a resiliently pivotable pipe guide tray.

2. A pipe-bending machine as described in claim 1 wherein said pressure means includes a rotation yoke pivotable about said bending mandrel comprising:

a yoke housing; and adjusting means located in said housing for fixedly moving the section of pipe against said bending mandrel.

3. A pipe-bending machine as in claim 2 wherein said adjusting means comprises:

a pair of guides each having a bore therethrough and aligned with one another both fixed within said housing;

a rotatable handle extending through said guide bores and having a distal end for handling and a proximal end with said proximal end being a pressure screw in combination with a lock ring for contacting a roller housing; and a slidable roller housing having a rotatable roller therein for contacting the pipe and thereby exerting pressure movement around said pre-determined curve.

4. A portable pipe-bending machine comprising:

a mounting bracket having an end wall and oppositely disposed side walls parallel to one another perpendicularly extending from said end wall;

a plurality of fixedly adjustable bracing supports attached to said bracket adjacent one another and extending therefrom;

a bending mandrel with an axis at a predetermined point therethrough and having an end surface with a centrally located groove therein and conforming to a pre-determined radius from said axis, said mandrel fixedly attached inside said bracket;

a releasably pivotable pipe guide tray attached from said one of the said side walls;

a rotatable yoke extending from said axis to a predetermined point below said mandrel; and a releasably adjustable roller slidably fixed inside said yoke to exert pressure on a semi-sleeve to distribute pressure around a section of pipe resting against said mandrel to force the section into a pre-determined curve as said yoke and semi-sleeve are rotated around said mandrel.

5. A pipe-bending machine as in claim 1 wherein said guide means is a semi-sleeve having a centrally-located groove to cradle the section of pipe and evenly distribute the bending forces.

* * * * *